US005576616A

United States Patent [19]

Ridgers

[11] Patent Number: 5,576,616

[45] Date of Patent: Nov. 19, 1996

[54] STABILIZED REFERENCE CURRENT OR REFERENCE VOLTAGE SOURCE

[75] Inventor: Timothy J. Ridgers, Bretteville L'Orgueilleuse, France

[73] Assignee: U.S. Philips Corporation, New York, N.Y.

[21] Appl. No.: 386,237

[22] Filed: Feb. 9, 1995

[30] Foreign Application Priority Data

Mar. 30, 1994 [FR] France ..... 94 03775

[51] Int. Cl.[6] ..... G05F 3/16

[52] U.S. Cl. ..... 323/314; 323/316

[58] Field of Search ..... 323/313, 314, 323/316, 315, 907

[56] References Cited

U.S. PATENT DOCUMENTS

| | | | |
|---|---|---|---|
| 3,930,172 | 12/1975 | Dobkin . | |
| 4,491,780 | 1/1985 | Neidorff | 323/313 |
| 4,682,098 | 7/1987 | Seevinck et al. | 323/315 |
| 4,816,742 | 3/1989 | van de Plassche | 323/314 |
| 4,958,122 | 9/1990 | Main | 323/315 |
| 5,015,942 | 5/1991 | Kolando | 323/315 |
| 5,049,807 | 9/1991 | Banwell et al. | 323/314 |
| 5,367,249 | 11/1994 | Honnigford | 323/313 |
| 5,399,914 | 3/1995 | Brewster | 323/315 |
| 5,432,432 | 7/1995 | Kimura | 323/313 |
| 5,446,409 | 8/1995 | Katakura | 323/315 |

FOREIGN PATENT DOCUMENTS

| | | | |
|---|---|---|---|
| 0329232 | 8/1989 | European Pat. Off. | G05F 3/30 |

*Primary Examiner*—Jeffrey L. Sterrett
*Attorney, Agent, or Firm*—Bernard Franzblau

[57] ABSTRACT

A circuit supplying a stabilised voltage (Vref) which is insensitive to variations of the supply voltage (Vcc) and of the temperature, comprises a cell of four transistors. The first two transistors have their bases and collectors cross-coupled, and the first transistor has its emitter coupled to the reference voltage (VEE) by a resistor and has an emitter area larger than the emitter area of the third transistor. A fifth transistor has an emitter connected to the collector of the fourth transistor and a base which is driven by a line via a resistor. This line is coupled to the supply voltage via a current source. This resistor has a value between 2 and 4 times that of a compensation resistor coupled between the third transistor and the line. Preferably, a capacitance is connected between the bases of the second and the fifth transistor. The circuit is useful as a reference voltage source in integrated circuits where the supply voltage is afflicted with noise.

13 Claims, 5 Drawing Sheets

STABILIZED REFERENCE CURRENT OR REFERENCE VOLTAGE SOURCE

FIELD OF THE INVENTION

This invention relates to a control circuit supplying a stabilised voltage and connected between a supply terminal and a reference terminal and comprising four transistors of the same conductivity type, each having an emitter, a base and a collector, a first transistor having its emitter coupled to the reference terminal via a first resistor, a second transistor having its emitter connected to the reference terminal, the bases and the collectors of the first and the second transistor being cross-coupled, a third transistor having its emitter connected to the collector of the first transistor and having its base and its collector connected together to one of the ends of a second resistor, which second resistor has its other end coupled to the supply terminal, and a fourth transistor having its emitter connected to the collector of the second transistor and having its base connected to the base and to the collector of the third transistor, in which circuit the emitter area of the first transistor is larger than that of the second transistor.

BACKGROUND OF THE INVENTION

Such a control circuit, based on a cell comprising four transistors of the same polarity, is known from the document EP-A-0,329,232, which corresponds to U.S. Pat. No. 4,816,742 Mar. 28, 1989. This document indicates that this basic four-transistor cell can form either a plurality of stabilised current sources or a voltage source which is independent of the supply voltage and the temperature. As stated in said document such stabilised current sources can be realised using only bipolar transistors of the NPN type. As a result, such a circuit can respond rapidly to supply voltage variations or to variations of the current drain at the output.

However, the known control circuit does not allow for the base currents of the transistors, so that the accuracy of the resulting stabilised voltage is still afflicted with errors referred to as second-order errors.

It is an object of the invention provide an improved control circuit supplying a stabilised voltage which is even less sensitive to the value of the supply voltage relative to a nominal voltage, which exhibits a substantial rejection of power-supply noise and which remains stable with respect to temperature variations.

SUMMARY OF THE INVENTION

According to the invention a control circuit of the type defined in the opening paragraph is characterised in that the circuit further comprises a bipolar fifth transistor of the same conductivity type as the afore-mentioned transistors, which fifth transistor has an emitter connected to the collector of the fourth transistor, a base coupled to its collector via a base resistor whose value is at least equal to twice the value of the second resistor, and in that the node between this base resistor and the collector of this fifth transistor is, on the one hand, coupled to the other end of the second resistor and is, on the other hand, coupled to the supply terminal via a current source.

As will be discussed in more detail hereinafter, the presence of the fifth transistor provides a compensation for some base currents, which compensation had been omitted in the known circuit. To achieve this, the base resistor of the fifth transistor is selected to have a value in relation to the value of the second resistor.

In a first variant of the invention the connection between the emitter of the fifth transistor and the collector of the fourth transistor forms a stabilised voltage output.

The value of this stabilised voltage is particularly independent of the supply voltage and has a high rejection ratio for supply voltage noise.

Suitably, the second, the fourth and the fifth transistor have equal emitter areas. It is known that the emitter area of the third transistor should be a submultiple of the emitter area of first transistor, which in practice is formed by combining a plurality of identical parallel-connected transistors, which are each of equivalent construction and paired with the third transistor.

For a simplified construction the third transistor may also have an emitter area equal to that of the second, the fourth or the fifth transistor.

In a second variant of the invention the control circuit is characterised in that it further comprises a sixth transistor and a seventh transistor of the same conductivity type as the preceding transistors, the diode-connected sixth transistor being poled in the forward direction between the other end of the second resistor and the current source, while the seventh transistor has its base connected to the emitter of the fourth transistor, has its collector coupled to the supply terminal, and has its emitter, which forms an output for the stabilised voltage, coupled to the reference terminal via an emitter resistor.

In this variant the impedance of the stabilised voltage output is lower and thus allows a higher output current drain in comparison with the preceding variant. Another advantageous feature is that the collector of the seventh transistor can also form a further output of the control circuit to supply a reference current which is stabilised with respect to the supply voltage and the temperature.

Since the control circuit in accordance with the invention can be realised bipolar transistors of the NPN type it is suited to respond to high frequencies, particularly to reject supply voltage fluctuations of high frequency at the output. For a further improvement of this rejection capability with respect to supply voltage noise the control circuit in accordance with the invention is advantageously completed with a capacitance connected in parallel between the bases of the fifth transistor and the second transistor.

The relevant capacitance can be small (for example some pF) so as to be integrated with the control circuit, its effect being multiplied by the gain of the second transistor. Its capability of rejecting supply voltage noise as a function of the frequency of this noise is found to increase with the frequency starting from a given frequency value of approximately 1 MHz. This property is in contrast to the performance of prior-an control circuits using a high-gain error amplifier which requires frequency stabilisation. Such control circuits on the contrary have a noise rejection capability which decreases beyond a limit frequency which in fact corresponds to the frequency from which the gain of the error amplifier is deliberately limited.

In a simplified embodiment of the control circuit in accordance with the invention the source of the current supplied to the control circuit from the power supply terminal is reduced to a resistor. In order to minimise the supply current, particularly in the case of battery-powered applications, it may be advantageous if the control circuit can be disabled completely, which is possible if the current source is realised by means of a resistor in series with a switching transistor of the MOS-FET type.

It is also possible to use current sources of other types, particularly sources which preregulate the current supplied to the control circuit.

The nature of the invention and how it can be implemented will be more fully understood with the aid of the following description with reference to the accompanying drawings, given by way of non-limitative examples.

DESCRIPTION OF PREFERRED EMBODIMENTS

Figure 1:
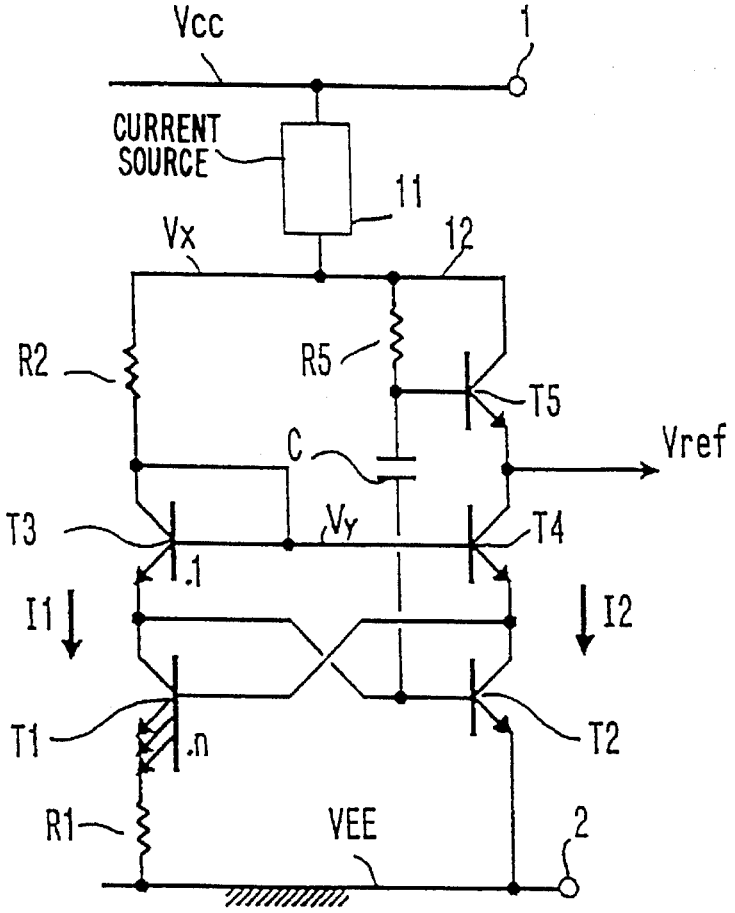
FIG. 1 is a diagram of a control circuit in accordance with a first embodiment of the invention.

For its power supply the control circuit shown in FIG. 1 is connected between a positive supply voltage terminal 1 carrying a voltage Vcc and a reference terminal 2 carrying a voltage VEE (ground). This circuit comprises a first transistor T1, whose emitter is coupled to the reference terminal 2 via an emitter resistor R1, and a second transistor T2, whose emitter is also connected to the reference terminal 2, the transistors T1 and T2 having their bases and their collectors cross-coupled. A third transistor T3 has its emitter connected to the collector of the first transistor T1, its base and collector, which are interconnected to form a diode configuration, being connected to a first end of a second resistor R2 and to the base of a fourth transistor T4 whose emitter is connected to the collector of the second transistor T2. The four transistors T1 to T4 are of the same conductivity type, in the present case of the NPN type, and the emitter area of the first transistor T1 is n times as large as that of the third transistor T3, the transistors T2 and T4 preferably having equal emitter areas, which may also be equal to that of the transistor T3. The other end of the second resistor R2 is coupled to the positive supply terminal 1 via a current source 11, which in the present example is simply formed by a resistor. The connection between the current source 11 and the resistor R2 forms a line 12 connected to a resistor R5 driving the base of a fifth transistor T5 whose collector is coupled to the line 12 and whose emitter is coupled to the collector of the fourth transistor T4.

The node between the emitter of the transistor T5 and the collector of the transistor T4 now constitutes the output of the control circuit and supplies a stabilised voltage Vref.

In a first rough analysis of the operation the base currents of all the transistors are ignored. It may then be assumed that a current I1 flows in the branch formed by the current path of the transistors T1 and T3 and the resistors R1 and R2. Likewise, another current I2 flows in the branch formed by the current path of the transistors T2, T4 and T5. Furthermore, it is known that the circuit comprising the four transistors T1 to T4 produces a current I1 whose value is proportional to the absolute temperature and depends only on the value of the resistor R1 and the ratio between the emitter areas of the transistor T1 and the transistor T3.

This property will be summarised by analyzing the value of the base voltage of the transistors T3 and T4 in two ways. If this voltage is Vy:

$$Vy=V_{BE}(T4)+V_{BE}(T1)+R1\cdot I1$$

$$Vy=V_{BE}(T3)+V_{BE}(T2)$$

where $V_{BE}$(Tx) is the base-emitter voltage of a transistor Tx. It follows that $$R1\cdot I1=V_{BE}(T3)+V_{BE}(T4)-V_{BE}(T4)-V_{BE}(T1)$$

Since the transistors T2 and T4 are identical and, in a first approximation, the same current I2 flows in these transistors the terms $V_{BE}$(T2) and $V_{BE}$(T4) cancel one another. This yields:

$$R1\cdot I1=V_{BE}(T3)-V_{BE}(T1)$$

or, when $$V_{BE}(T3)-V_{BE}(T1)=\frac{kT}{q}\,\mathrm{Ln}\left(\frac{J(T_3)}{(J(T1)}\right)$$

is used, where J(T3) and J(T1) are the current densities in the emitters of T3 and T1, k is Boltzmann's constant, T is the absolute temperature and q is the elementary charge, $$I1=\frac{kT}{qR1}\,\mathrm{Ln}\left(\frac{J(T_3)}{J(T1)}\right) \tag{1}$$

If n is the ratio between the emitter areas of these transistors, in which the same current I1 flows, equation (1) may be written as:

$$I1=\frac{kT}{qR1}\,\mathrm{Ln}(n) \tag{2}$$

Equation (2) corroborates the proportionality between I1 and the absolute temperature.

The current source 11 forms a highly imperfect current source, in which a current flows which varies with the supply voltage Vcc. Thus, since the voltage on the line 12 is substantially determined by the sum of the base-emitter voltages of the transistors T2 and T3 plus the voltage drop produced across the resistor R2 by the current I1, the current I2 simply follows from the difference between the current supplied by the current source 11 and the current I1. If the base currents are still ignored the emitter of the transistor T5 will carry a voltage derived from the voltage Vx by subtraction of a base-emitter voltage of this transistor, which supplies the current I2.

The transistor T5 is chosen to have an emitter area equal to that of the transistors T2 and T4, in such a manner that the base-emitter voltage drop of the transistor T5 compensates for the voltage drop in the transistor T2. It follows that the output voltage Vref of the circuit is substantially equal to the sum of a voltage drop I1·R2 with a positive temperature coefficient and one base-emitter voltage of the transistor T3 in which a current I1 flows, which base-emitter voltage has a negative temperature coefficient. The value of the resistor R2 is selected in such a manner that the two components of the sum of the voltages have a temperature coefficient which is reduced to zero. In practice, it is customary to use a voltage drop I1·R2 whose value is of the order of 500 mV.

From this coarse first analysis it follows that the output voltage Vref of the control circuit is independent of the temperature and of the value of the current I2, i.e. independent of the supply voltage Vcc. A more detailed analysis, which allows for the base currents of the various transistors, shows that the current through the resistor R2 is approximately equal to the current I1 flowing in the transistor T1 plus the base current of the transistor T4, leading to an increase of the initially calculated voltage drop across the resistor R2.

Since, in a first approximation, the base current of the transistor T5 is substantially equal to the base current of the transistor T4 or to the base current of the transistor T2, a compensation for said effect on the voltage Vx on the line 12 ought to be obtained when the resistor R5, arranged in the base of the transistor T5, has a value equal to twice the value of the resistor R2. Thus, the increase of the voltage Vx ought to be compensated for at the output of the control circuit.

In practice, however, this compensation appears to be slightly inadequate, particularly because a variation of the base current of the transistor T2 gives rise to a very small variation of the base-emitter voltage of the transistor T3, which variation has been ignored in the above calculations. The immunity of the output voltage Vref to variations of the supply voltage Vcc can be improved by increasing the value of the resistor R5, whose value then ranges between 2 and 4 times the value of the resistor R2. The optimum value can be determined by means of a suitable calculation and, preferably, by means of a simulator.

For reasons of symmetrical operation of the circuit the value for the current source 11 is chosen in such a manner that the currents I1 and I2 are substantially equal for a nominal supply voltage Vcc. For values of the supply voltage Vcc which differ from the nominal value, at a given temperature, the current I2 will vary but, as is apparent from the above, the resulting stabilised voltage Vref is disturbed only slightly.

Since, in a preferred embodiment, all of the transistors used in the circuit are of the NPN type the control circuit is capable of responding to supply voltage fluctuations, even when they are of a high frequency.

The rejection of noise in the supply voltage Vcc can be further improved in a preferred embodiment, in which the base of the transistor T5 is coupled to the base of the transistor T2 by means of a capacitor C. This capacitor can be integrated easily because a small value will be adequate. Its effect is multiplied, in a first approximation, by the gain of the transistor T2.

Figure 2:
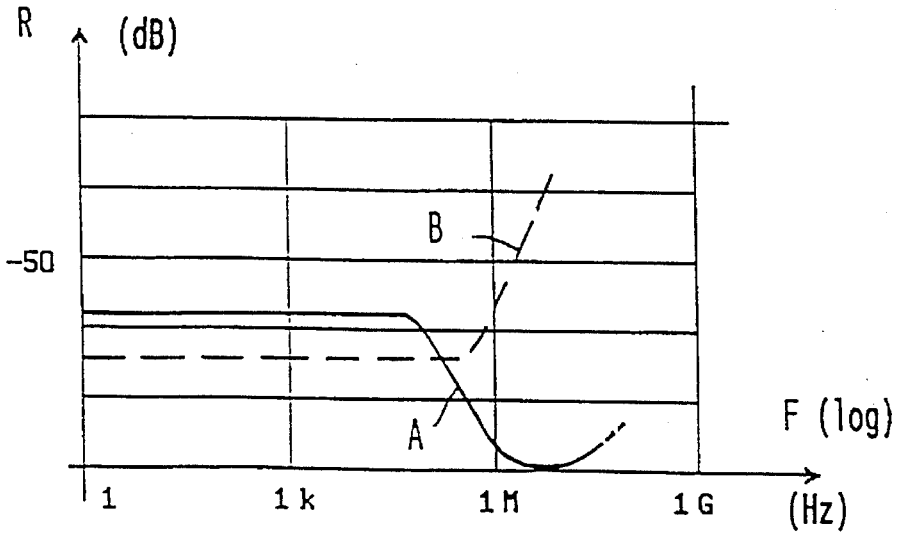
FIG. 2 is a diagram representing the rejection of supply voltage noise at the output of the control circuit as a function of the frequency of this noise.

For this embodiment the curve A in FIG. 2 represents the rejection ratio R of the noise at the output of the control circuit relative to the noise on the supply voltage Vcc as a function of the frequency F of this noise. An interesting feature of the control circuit in accordance with the invention is that the rejection ratio increases beyond a given limit frequency. This feature is particularly interesting when the control circuit is used in applications where the circuit is integrated with high-frequency switching circuits, for example frequency dividers which give rise to high frequency noise on the supply voltage.

Figure 3:
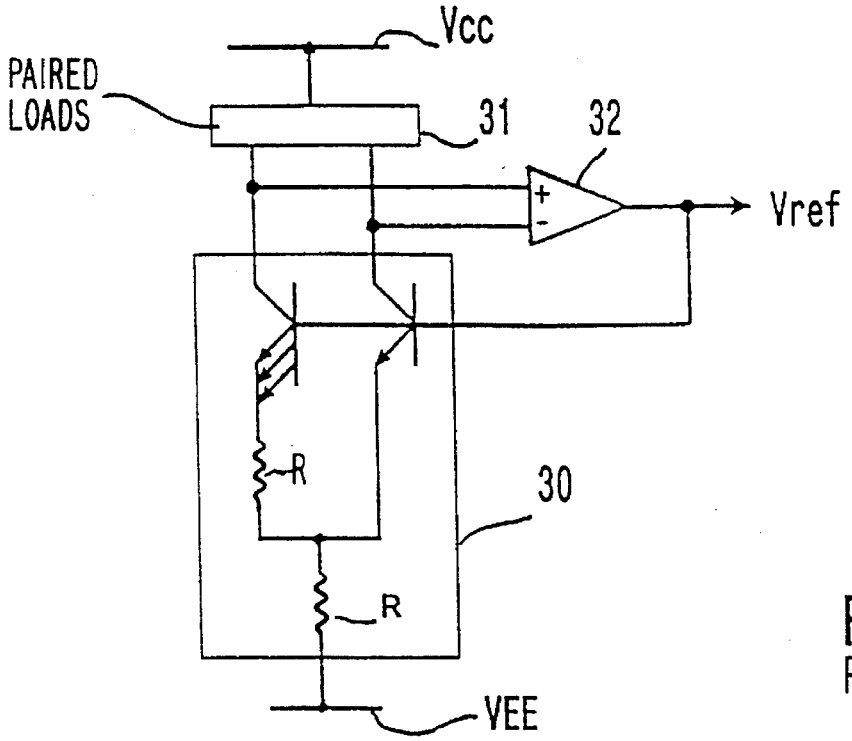
FIG.3 PRIOR ART
FIG. 3 is a basic diagram of a known control circuit of a certain type and FIG. 4 is a diagram representing the gain as a function of the frequency for an error amplifier used in such a known circuit.
Figure 4:
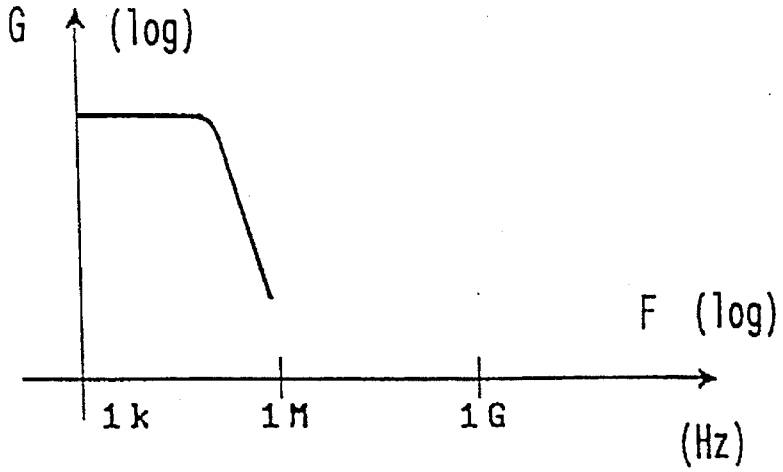
FIG.4 PRIOR ART

FIG. 3 very diagrammatically illustrates the principle underlying several known control circuits. They comprise a cell 30 of two transistors whose emitter areas are not equal and intended to supply a current proportional to the temperature at a compensation resistor R. The collectors of the transistors drive paired loads, represented symbolically as a block 31. The circuit further comprises a high-gain differential amplifier 32 whose output drives the coupled bases of the two transistors, the entire arrangement being such that the collector currents of the transistors are equal. Thus, the amplifier 32 is an error amplifier and therefore the reference voltage Vref at the output of this amplifier is more accurate as the gain of the amplifier increases. Moreover, it is well-known that such an amplifier should be frequency-stabilised and therefore has a gain characteristic G as shown in FIG. 4.

Likewise, the rejection R of the noise on the supply voltage for a control circuit of this type varies in accordance with a characteristic which is the inverse of that of the gain, such as that represented by the curve B in FIG. 2. It is evident that from the point of view of noise rejection the circuit in accordance with the invention is very advantageous for applications where high-frequency noise occurs.

Figure 5:
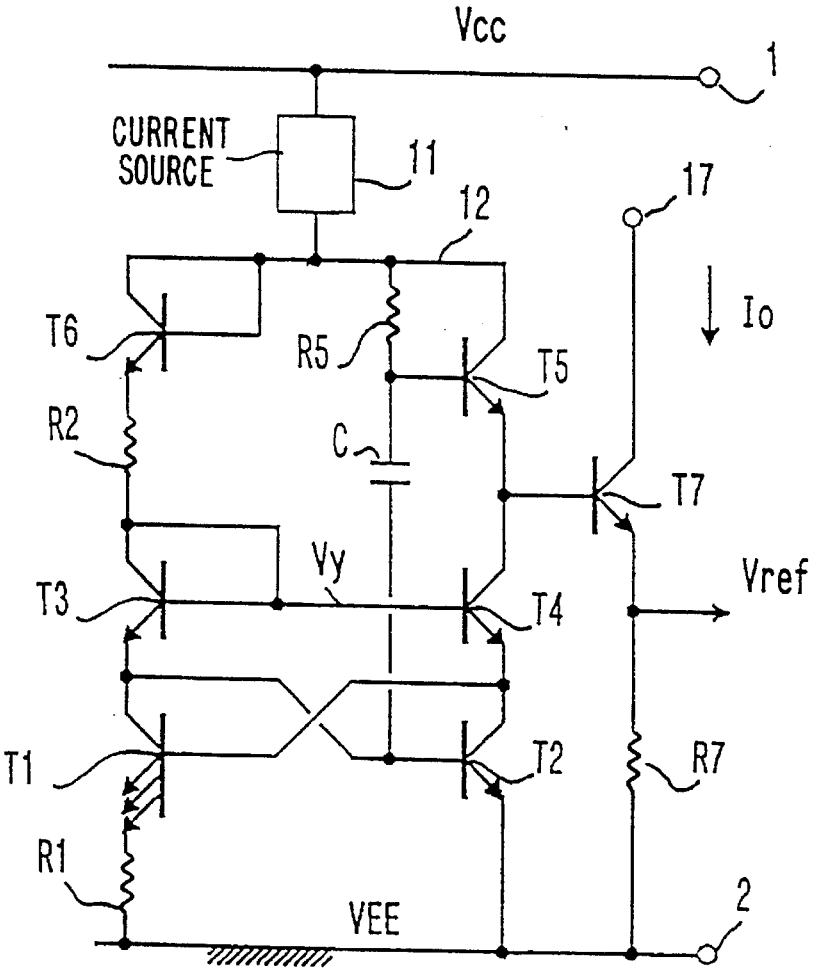
FIGS. 5 and 9 are diagrams of a second embodiment of the control circuit in accordance with the invention.

FIG. 5 is a diagram showing a second embodiment of the invention.

In this Figure elements corresponding to those in the circuit shown in FIG. 1 bear the same reference symbols. The circuit shown in FIG. 5 includes all the elements of the circuit in FIG. 1 and, in addition, a sixth transistor T6 and a seventh transistor T7 of the same conductivity type as the transistors T1 to T5. The transistor T6 is connected as a diode, its emitter-collector path (coupled to the base) being arranged between the resistor R2 and the line 12. Thus, the voltage Vx on the line 12 is raised by the value of one $V_{BE}$ in comparison with the example described above.

The transistor T7 has its base connected to the node between the emitter of the transistor T5 and the collector of the transistor T4. Its emitter is coupled to the reference terminal 2 via an emitter load resistor R7. Thus, the transistor T7 is arranged as an emitter-follower and supplies the stabilised voltage Vref on its emitter. In a first approximation the base-emitter voltage drop of T7 compensates for the voltage drop in the transistor T6, in such as manner that the voltage Vref is again substantially equal to that obtained by means of the circuit shown in FIG. 1.

In the present embodiment the output impedance of the circuit is lower than in the preceding embodiment and a larger current can be taken from the output.

Figure 9:
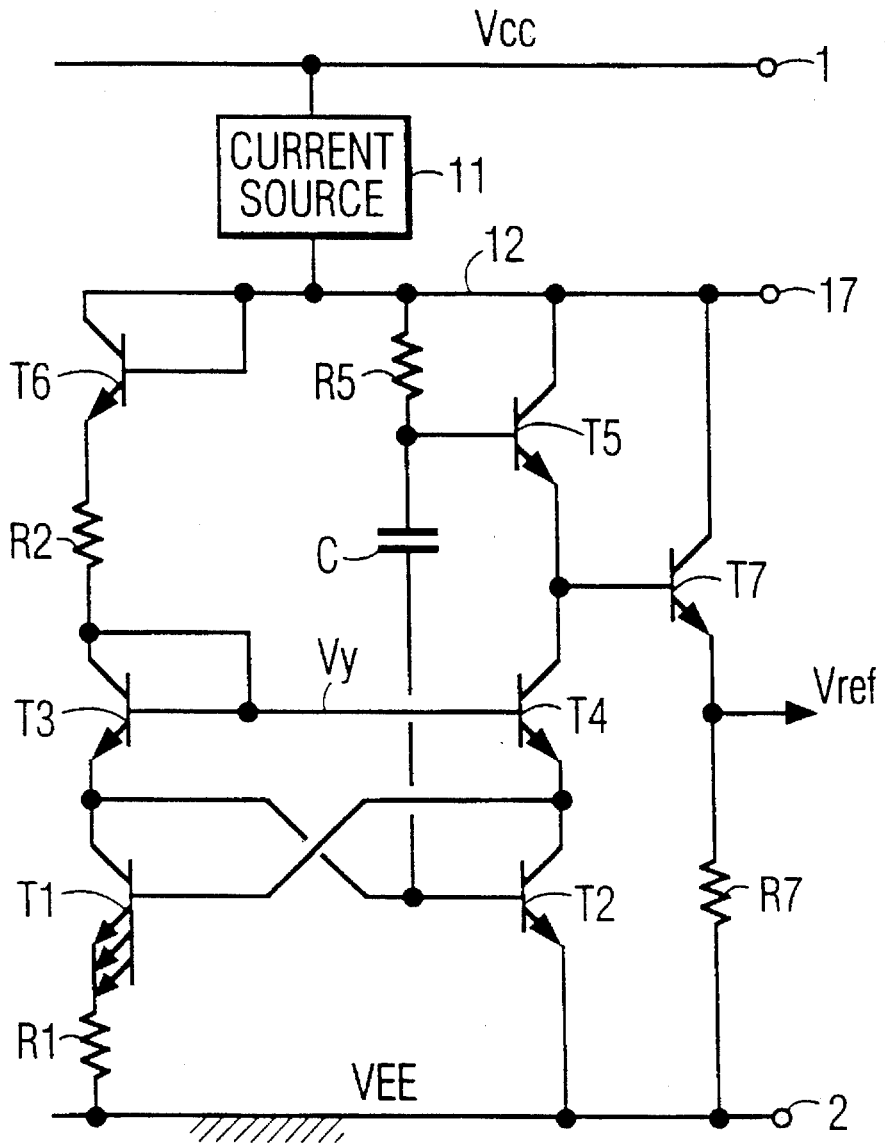

The collector of the transistor is shown as being driven by a terminal 17. This terminal may be coupled directly to the line 12, as shown in FIG. 9, or to the supply terminal 1. However, the circuit shown can also supply a stabilised reference current Io, which is sunk by the collector of the transistor T7. The terminal 17 then forms an output of the control circuit.

It is evident that the current Io is independent of the supply voltage and of the temperature because it is derived from the emitter current of the transistor T7, which produces a stable voltage drop Vref across the resistor R7. The collector current of the high-gain NPN-type transistor T7 differs little from the emitter current and, as a result, is not influenced significantly by gain variations as a function of the temperature.

Obviously, the current source 11, which is shown as a so-called limiting resistor in FIG. 1, is merely a simplified example and it is also possible to use any other current source comprising means which effect, for example, a similar coarse preregulation of the current applied to the two branches of the control circuit. In applications where the voltage control circuit is not permanently used it is desirable that the control circuit can be disabled when it need not be used, in order to reduce the current consumption.

Figure 6:
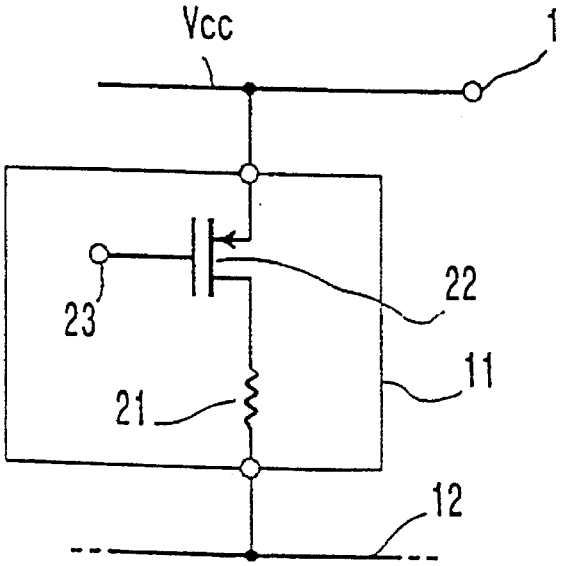
FIGS. 6, 7 and 8 are diagrams of examples of current sources suitable for use in the control circuit in accordance with the invention.

FIG. 6 shows an example in which the current source 11 of FIG. 1 has been replaced by a combination of a resistor 21 and a MOS-FET 22. By means of a suitable command applied to the terminal 23, which is coupled to the gate of the transistor 22, it is possible to obtain a switchable current source whose resistance is equal to the sum of the value of the resistor 21 and the internal resistance of the transistor 22 when it is conductive.

Figure 7:
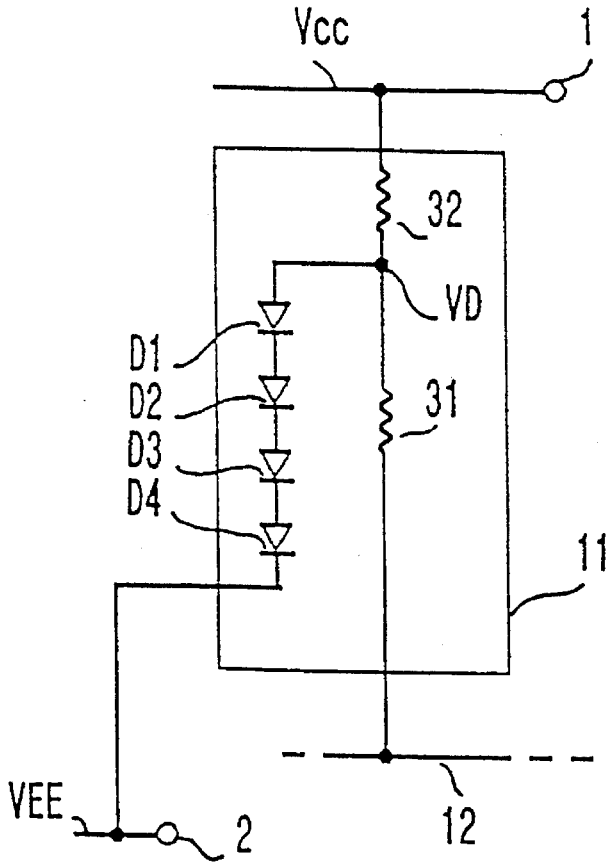

FIG. 7 shows another example of the current source 11 comprising means which preregulate the current applied to the control circuit.

Two resistors 31 and 32 are connected in series between the supply terminal 1 and the line 12. The voltage $V_D$ on the node between these resistors is stabilised by means of four diodes D1 to D4 connected in series between this node and the reference terminal 2. Although the forward voltage of these diodes varies slightly as a function of the temperature and of the current through these diodes this variation remains so small that the current supplied by the current source 11 is controlled mainly by the limiting resistor 31 and the voltage difference $V_D$–Vx, which varies little as a function of variations of Vcc.

Figure 8:
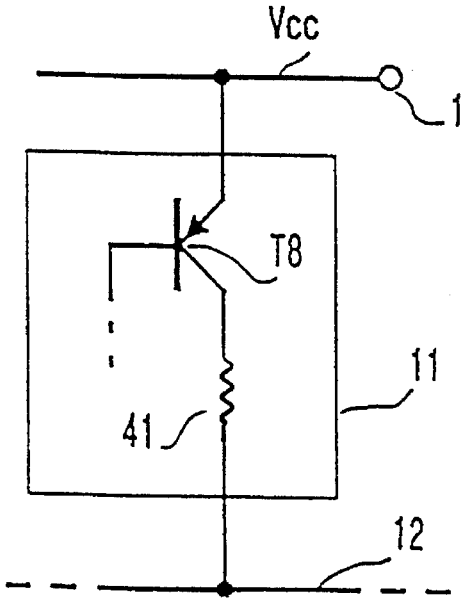

FIG. 8 shows another example of the current source 11, using at least one PNP-type transistor T8, which by any known means, preregulates the current delivered by its emitter-collector path.

The use of a PNP-type transistor has the drawback that the parasitic capacitance of such a transistor is generally substantial, which is unfavourable in view of the rejection of noise on the supply voltage. In order to mitigate this effect a resistor 41 is arranged between the collector of the transistor T8 and the line 12 so as to reduce the influence of the parasitic capacitance of the transistor T8.

It is evident that the current sources described with reference to FIGS. 6, 7 and 8 are merely examples and that the expert will be able to conceive other combinations, particularly those using the switching transistor 22 of FIG. 6 when this is useful. The examples of control circuits shown in FIGS. 1 and 5 can be modified without departing from the scope of the invention as defined hereinafter.

I claim:

1. A control circuit supplying a stabilised voltage, connected between a supply terminal and a reference terminal, and comprising: four transistors of the same conductivity type, each having an emitter, a base and a collector, a first transistor having its emitter coupled to the reference terminal via a first resistor, a second transistor having its emitter connected to the reference terminal, the bases and the collectors of the first and the second transistor being cross-coupled, a third transistor having its emitter connected to the collector of the first transistor and having its base and its collector connected together to one end of a second resistor, and a fourth transistor having its emitter connected to the collector of the second transistor and having its base connected to the base and to the collector of the third transistor, wherein the emitter area of the first transistor is larger than that of the second transistor, a fifth transistor of the same conductivity type as the four transistors and with an emitter connected to the collector of the fourth transistor, a base coupled to its collector via a base resistor whose value is at least equal to twice the value of the second resistor, and wherein a node between said base resistor and the collector of the fifth transistor is coupled to the other end of the second resistor and to the supply terminal via a current source.

2. A control circuit as claimed in claim 1, wherein the second, the fourth and the fifth transistor have equal emitter areas.

3. A control circuit as claimed in claim 1 wherein the connection between the emitter of the fifth transistor and the collector of the fourth transistor forms an output for the stabilised voltage.

4. A control circuit as claimed in claim 1 which further comprises a diode-connected sixth transistor and a seventh transistor of the same conductivity type as the four transistors, the diode-connected sixth transistor being poled in the forward direction between the other end of the second resistor and the current source, while the seventh transistor has its base connected to the emitter of the fifth transistor, has its collector coupled to the supply terminal, and has its emitter, which forms an output for the stabilised voltage, coupled to the reference terminal via an emitter resistor.

5. A control circuit as claimed in claim 4, wherein the collector of the seventh transistor forms an output of the control circuit at which a stabilised reference current is produced.

6. A control circuit as claimed claims 1 further comprising a capacitance connected between the base of the fifth transistor and the base of the second transistor.

7. A control circuit as claimed in claim 1 wherein the current source comprises limiting resistor.

8. A control circuit as claimed in claim 7, further comprising a switching transistor of the MOS-FET type coupled between the limiting resistor and the supply terminal.

9. A control circuit as claimed in 7 wherein current source further comprises means for preregulating the current applied to the control circuit.

10. A control circuit as claimed in claim 2, wherein the connection between the emitter of the fifth transistor and the collector of the fourth transistor forms an output for the stabilised voltage.

11. A control circuit as claimed in claim 2, which further comprises a diode-connected sixth transistor and a seventh transistor of the same conductivity type as the four transistors, the diode-connected sixth transistor being poled in the forward direction between the other end of the second resistor and the current source, while the seventh transistor has its base connected to the emitter of the fifth transistor, has its collector coupled to the supply terminal, and has its emitter, which forms an output for the stabilised voltage, coupled to the reference terminal via an emitter resistor.

12. A control circuit as claimed in claim 2, further comprising a capacitance connected between the base of the fifth transistor and the base of the second transistor.

13. A control circuit as claimed in claim 4, further comprising a capacitance connected between the base of the fifth transistor and the base of the second transistor.

* * * * *